US005179984A

United States Patent [19]

Sharp

[11] Patent Number: 5,179,984

[45] Date of Patent: * Jan. 19, 1993

[54] STORAGE TANK SYSTEM HAVING AN INTERNAL OVERFILL MEANS

[76] Inventor: Bruce R. Sharp, 7685 Fields-Ertel Rd., Cincinnati, Ohio 45241

[ * ] Notice: The portion of the term of this patent subsequent to May 28, 2008 has been disclaimed.

[21] Appl. No.: 706,046

[22] Filed: May 28, 1991

Related U.S. Application Data

[63] Continuation-in-part of Ser. No. 405,198, Sep. 11, 1989, Pat. No. 5,078,187, and a continuation-in-part of Ser. No. 547,914, Jul. 3, 1990, Pat. No. 5,018,558, which is a continuation of Ser. No. 279,836, Dec. 5, 1988, abandoned, which is a continuation-in-part of Ser. No. 66,691, Jun. 26, 1987, abandoned.

[51] Int. Cl.[5] ..... F16K 24/00; B65B 31/00

[52] U.S. Cl. ..... 141/198; 137/587; 141/59; 141/35; 141/290

[58] Field of Search ..... 141/51, 54, 57, 59, 141/35, 40, 86, 192, 198, 230-232, 285, 301, 302; 137/587-589, 386, 393

[56] References Cited

U.S. PATENT DOCUMENTS

| | | | |
|---|---|---|---|
| 2,771,917 | 11/1956 | Cannell | 141/217 |
| 3,732,902 | 5/1973 | Muller | 141/198 |
| 3,770,028 | 11/1973 | Madden | 141/59 |
| 3,983,913 | 10/1976 | Bower | 141/95 |
| 4,592,386 | 6/1986 | Mooney | 141/59 |
| 5,018,558 | 5/1991 | Sharp | 141/198 |
| 5,078,187 | 1/1992 | Sharp | 141/198 |

*Primary Examiner*—Ernest G. Cusick
*Attorney, Agent, or Firm*—Charles R. Wilson

[57] ABSTRACT

An underground storage tank system has an internal retained capacity area for receiving excess liquid from a filling operation. The storage tank system comprises a rigid storage tank, a fill pipe, a vapor recovery tube, a vent line, a dispensing line, and a trapped vapor release valve. A vapor recovery extension tube and vent extension line each extend into the storage tank. The uppermost of the lower end of the vapor recovery extension tube and lower end of the vent extension line within the storage tank defines a horizontal plane above which is an internal retained capacity area. The trapped vapor release valve is closed during a filling operation so that eventually a build up of pressure occurs within the retained capacity area to prevent further flow of liquid to the retained capacity area of the tank. Opening of the trapped vapor release valve relieves the pressure in the retained capacity area thereby allowing excess liquid in the fill pipe and delivery hose to drain into the storage tank.

12 Claims, 6 Drawing Sheets

STORAGE TANK SYSTEM HAVING AN INTERNAL OVERFILL MEANS

This application is a continuation-in-part of "Vented Storage Tank Systems With Internal Overfill-Means", Ser. No. 07/405,198, filed Sep. 11, 1989, now U.S. Pat. No. 5,078,187 and a continuation-in-part of "Storage Tank System With Internal Overfill Means", Ser. No. 07/547,914, filed Jul. 3, 1990, now U.S. Pat. No. 5,018,558, which is a continuation of "Storage Tank System With Internal Overfill Means", Ser. No. 07/279,836, filed Dec. 5, 1988, now abandoned, which is a continuation-in-part of "Total Containment and Overfill Storage Tank System", Ser. No. 07/066,691, filed Jun. 26, 1987, now abandoned.

FIELD OF THE INVENTION

This invention relates to a liquid storage tank system. More particularly, the invention relates to an underground storage tank system having a means to safely handle overfill liquid from a filling operation.

BACKGROUND OF THE INVENTION

Storage tanks are widely used for storing a variety of liquids. Some of these liquids are hazardous and can be corrosive and/or flammable. In particular, underground storage tanks are used extensively for the storage of liquid gasoline at retail gasoline stations. Filling of the tanks is accomplished from a transport tank truck parked adjacent the top of a fill pipe located at ground level. The fill pipe is permanently connected to the underground storage tank. The transport tank truck operator attaches a flexible delivery hose leading from the truck's control panel to a liquid tight fitting on the top end of the tank's fill pipe. The operator next opens a valve located at the transport tank truck. Gasoline fills the flexible hose, the underground tank's fill pipe and finally the storage tank.

The filling operation is normally accomplished by gravity unloading of the gasoline in the transport tank truck to the underground tank. The gasoline flows into the underground storage tank until the filling operation is stopped by the tank truck operator or the underground tank and access pipes completely fill creating an overfill situation. Such overfill results in a substantial amount (up to about thirty-five gallons) of gasoline trapped in the commonly used four inch diameter flexible delivery hose. When an overfill occurs, the operator first turns off the valve at the transport tank truck. Unless special precautions are taken, gasoline contained within the flexible delivery hose is spilled onto the ground causing earth and water contamination.

Present underground tanks are required by federal regulations to have an overfill containment device to prevent overfilling. Various overfill devices and auxiliary holding tank systems are known in the prior art. Examples of these are disclosed in U.S. Pat. Nos. 3,983,913; 4,204,564; and 4,501,305. The disclosed systems are not fully satisfactory in one way or another.

There has now been discovered a storage tank system with provision for overfilled liquid. The present invention solves the problems inherent with existing storage tank systems and auxiliary overfill equipment.

SUMMARY OF THE INVENTION

The storage tank system of the invention comprises (a) a rigid storage tank, (b) a fill pipe extending from near ground surface into the storage tank for delivering liquid therethrough, (c) a vapor recovery tube attached to the storage tank and a vapor recovery extension tube extending from the vapor recovery tube into the storage tank with a lower end of the vapor recovery extension tube terminating from about two inches to about eighteen inches from a top inside surface of the storage tank's storage area, (d) a vent line and vent extension line extending into the storage tank wherein a lower end of the vent extension line terminates from about two inches to about eighteen inches from the top inside surface of the tank's storage area and the vent line is open to the atmosphere, (e) a dispensing line leading from within the storage tank to a dispenser at ground surface; (f) a trapped vapor release valve in operable association with the tank's storage area, and (g) a by-pass vent line extending from the trapped vapor release valve directly to the vapor recovery tube so that upon opening of the trapped vapor release valve trapped vapors in an internal retained capacity area of the storage tank exit the tank through the by-pass vent line and vapor recovery tube so as to permit excess liquid in the fill pipe to freely flow. The retained capacity area in the storage tank comprises that portion of the tank's storage area which is above the uppermost of the lower ends of the vapor recovery extension tube and vent extension line. The trapped vapor release valve is closed during a filling operation so that vapors in the retained capacity area will prevent liquid from so entering. Opening of the trapped vapor release valve vents the trapped vapors and allows liquid in the fill pipe and delivery hose to flow into the retained capacity area.

DETAILED DESCRIPTION OF THE INVENTION

While the description which follows describes the invention in terms of its use with underground gasoline storage tanks, it should be understood the invention has applicability for other uses as well. For example, storage tanks used for storing liquids other than gasoline can utilize the present invention.

Figure 1:
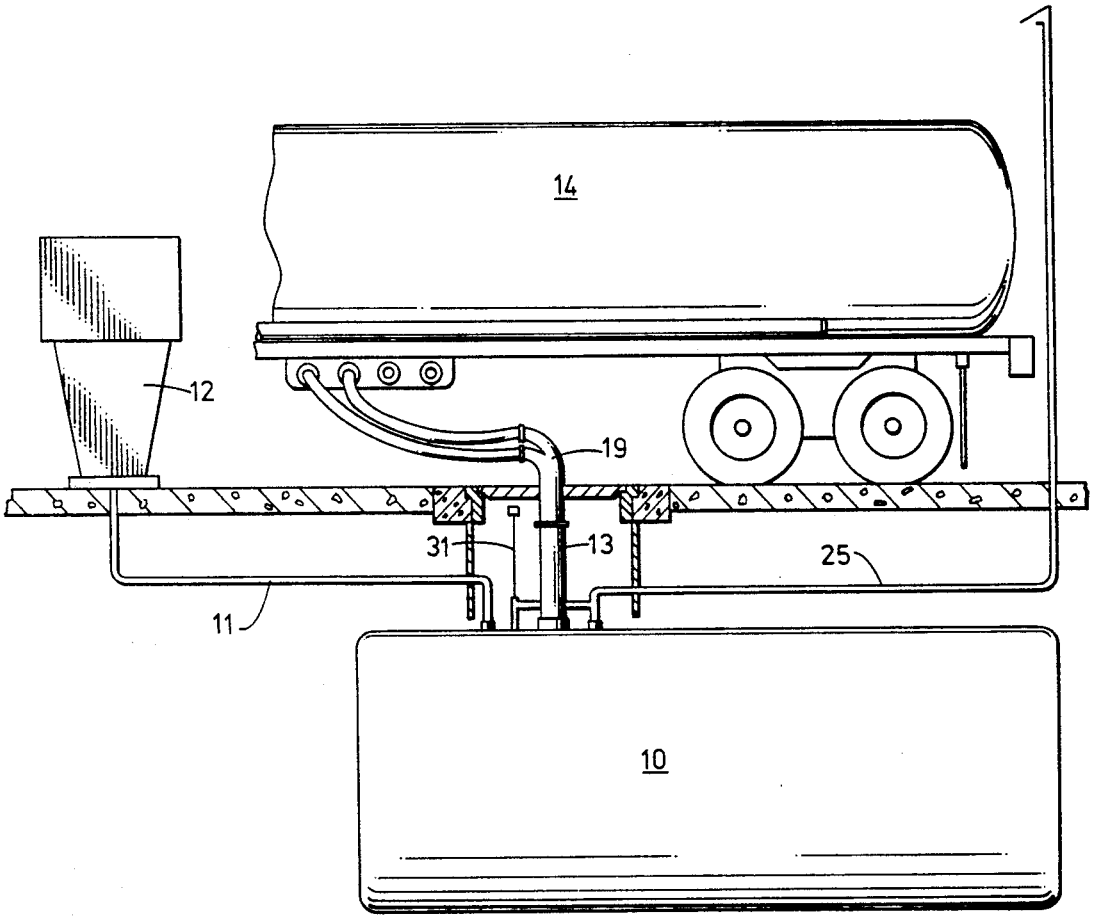
FIG. 1 is a side view of a storage tank system of this invention in the process of being filled from a transport truck.
Figure 2:
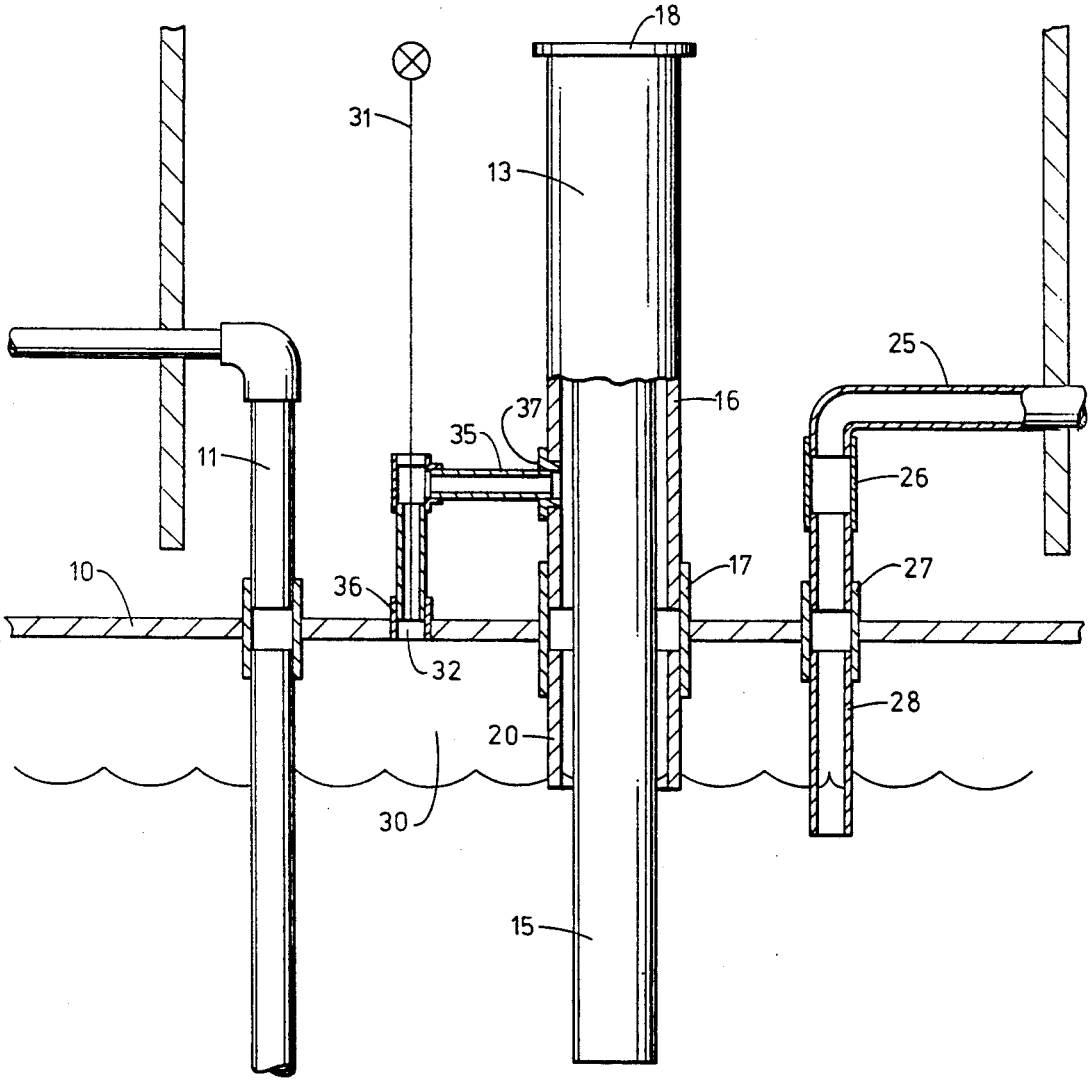
FIG. 2 is a partial side view in section of the storage tank system of FIG. 1 showing in detail a coaxial fill system and an internal retained capacity area.
Figure 3:
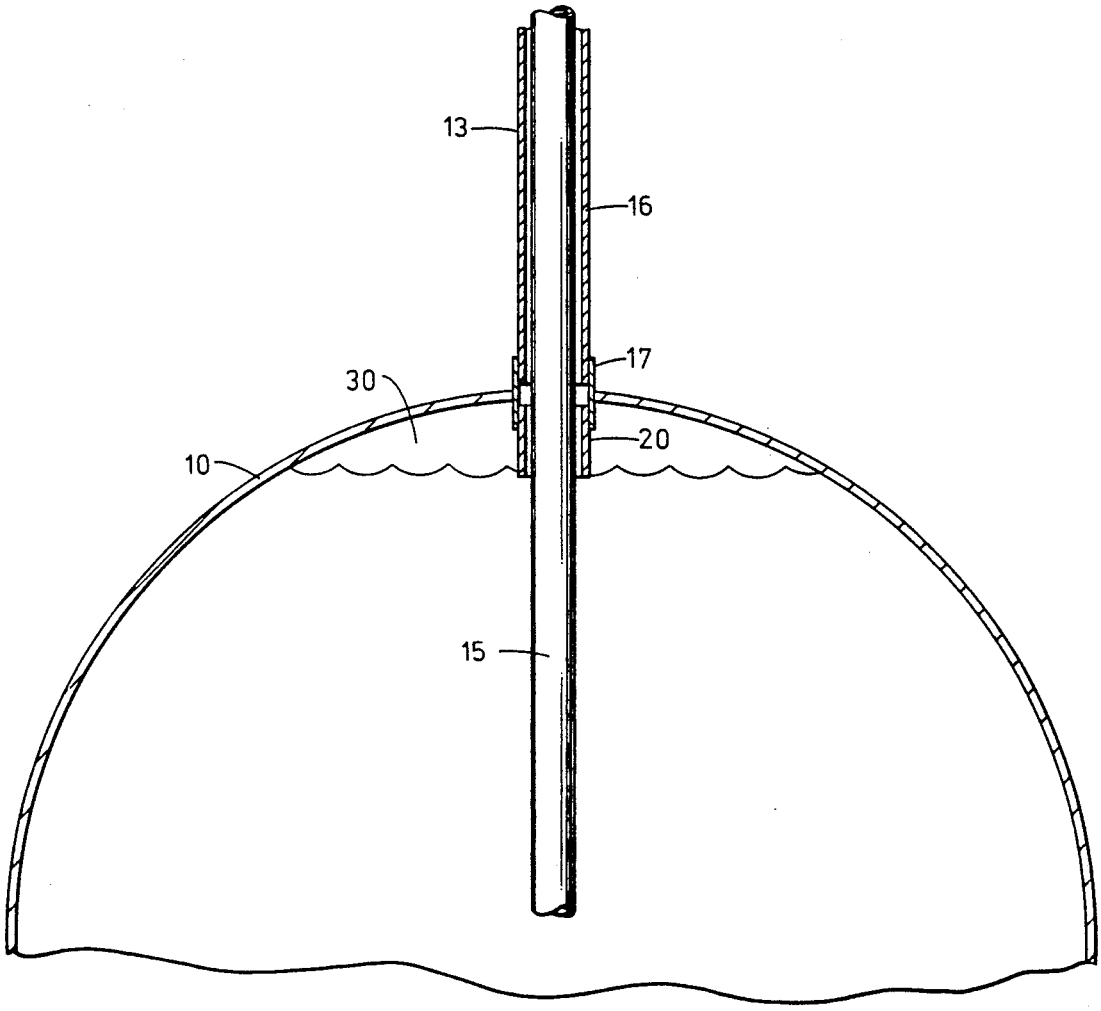
FIG. 3 is a partial end view in section of the storage tank system of FIG. 1 showing the internal retained capacity area for handling overfilled liquid.

With reference to FIGS. 1–3 there is shown an underground storage tank 10. Storage tanks 10 of the type shown are well known and are widely used, especially in the gasoline service station industry. They are typically made of metal or, more recently, a fiberglass reinforced resin material. Either type of tank or a composite structure of the two has use in this invention. Such tanks have a capacity of at least about 1,000 gallons of liquid, preferably at least about 4,000 gallons of liquid. A typical metal storage tank is shown in FIG. 1. The tank is cylindrically shaped and is usually buried about four feet. Various support and hold-down means (not shown) are used to keep the tank stationary. Access lines for dispensing, filling, and venting operations lead into the tank's interior storage area. Such lines are attached to the tank's top surface in a liquid tight fashion. As shown a ground level manway pit is provided to allow convenient access to all the access lines and tank.

A dispensing line 11 is used for withdrawing gasoline from the tank and delivering it to the consumer through a gasoline dispenser 12. The line enters the storage tank 10 by means of known liquid tight fittings. The line extends down into the tank to near its bottom surface. Normally a submerged pump is positioned within the tank to supply the dispenser. Another method of pumping the gasoline from the tank is accomplished by the dispenser having contained within it a suction pump to withdraw the gasoline from the tank.

A coaxial fill line 13 extends from the storage tank 10 to near ground level. It provides as its obvious function the conduit through which gasoline flows into the storage tank from an outside source, e.g., a transport tank truck 14. The coaxial fill line has an interior fill pipe 15 through which liquid gasoline passes during the filling operation. The fill pipe preferably extends into the tank's storage area to near its bottom surface to minimize splashing and vapor formation during a filling operation. A vapor recovery tube 16 is represented by a concentric outer pipe. The tube returns vapors formed within the storage tank during the filling operation to the transport tank truck, and thus, effectively handles such vapors without polluting the atmosphere. The coaxial fill line 13 is securely fastened to a double tapped bushing 17, which is attached to the top of tank 10. A removable cap 18 attaches to a cap adapter at a top end of the fill line. The cap adapter is used for assuring a liquid tight attachment with the transport truck's delivery hose 19. Coaxial fill lines of this general nature are common and are mandated in many areas. In accord with this invention, a lower vapor recovery extension tube 20 leading from the vapor recovery tube 16 extends from about two inches to about eighteen inches from the top inside surface of the storage tank into the tank's interior.

A vent line 25 leading into the tank 10 provides a means by which displacement of air/vapors can be directed to the atmosphere primarily during one part of the filling operation and also to prevent a vacuum formation during emptying of the tank 10. The vent line 25 is secured to the top of the tank by use of a threaded bushing 27. A coupling 26 is provided in the vent line for pipe connection purposes. In normal practice, the vent line 25 ends at the top of the storage tank. In accord with this invention, a lower vent extension line 28 leads from the bushing 27 into the uppermost portion of the interior storage area. The vent extension line extends from about two inches to about eighteen inches from the top inside surface of the storage tank into the tank's interior. Optionally, a ball float valve is installed at the end of the vent extension line 28 to prevent liquid from entering.

Thus, the vapor recovery extension tube and the vent extension line each extend from the top surface of the tank into the tank's storage area from about two inches to about eighteen inches. Preferably, the vapor recovery extension tube and vent extension line each end from about two inches to about five inches from the top inside surface of the storage tank. The area 30 within the storage tank is defined by an imaginary horizontal plane extending from the vapor recovery extension tube termination and vent extension line termination which is uppermost within the tank and the upper walls of the tank. This area is referred to herein as the storage tank's internal retained capacity area. The retained capacity area is capable of holding at least about five gallons, with the most preferred capacity being about thirty gallons to fifty gallons. In operation, the retained capacity area is used to receive excess liquid primarily from the transport truck's delivery hose and fill pipe.

When the liquid being filled into tank 10 reaches the uppermost opening within the tank of lines 20 and 28, air and other vapors will become trapped in the tank to form the interior retained capacity area 30. A pressure build-up within this area from a lack of venting will prevent additional liquid from entering this part of the tank. Any liquid which continues to flow from the transport truck will occupy the fill pipe, vapor recovery extension tube 20, vapor recovery tube 16, vent extension line 28, vent line 25 and delivery hose 19 to equalized levels with liquid remaining in the transport truck's tank. The filling operation is effectively terminated with a consequent overfill situation.

After the delivery line valve at the transport truck is turned off, the line is drained by use of a control rod 31 operably associated with a trapped vapor release valve 32 located at its end and a by-pass vent line 35. The by-pass vent line 35 is connected securely by a bushing 36 to the top surface of the tank. It communicates directly with the vapor recovery tube 16 through a fitting 37. When the valve 32 is opened the trapped vapors are vented out of the retained capacity area 30 through the by-pass vent line 35 and the vapor recovery tube 16 back into the transport tank truck 14. The liquid trapped in the flexible delivery hose, fill pipe, vapor recovery extension tube, vapor recovery tube, vent extension line and vent line can now displace the trapped vapors in the retained capacity area 30. It should be appreciated the by-pass vent line connected directly to the vapor recovery tube and operated by the single control valve is a relatively simple design which makes it particularly attractive to install, to use, and to maintain. In particular, a minimum of modification to an existing storage tank system allows it to be readily retrofitted thereto.

Figure 4:
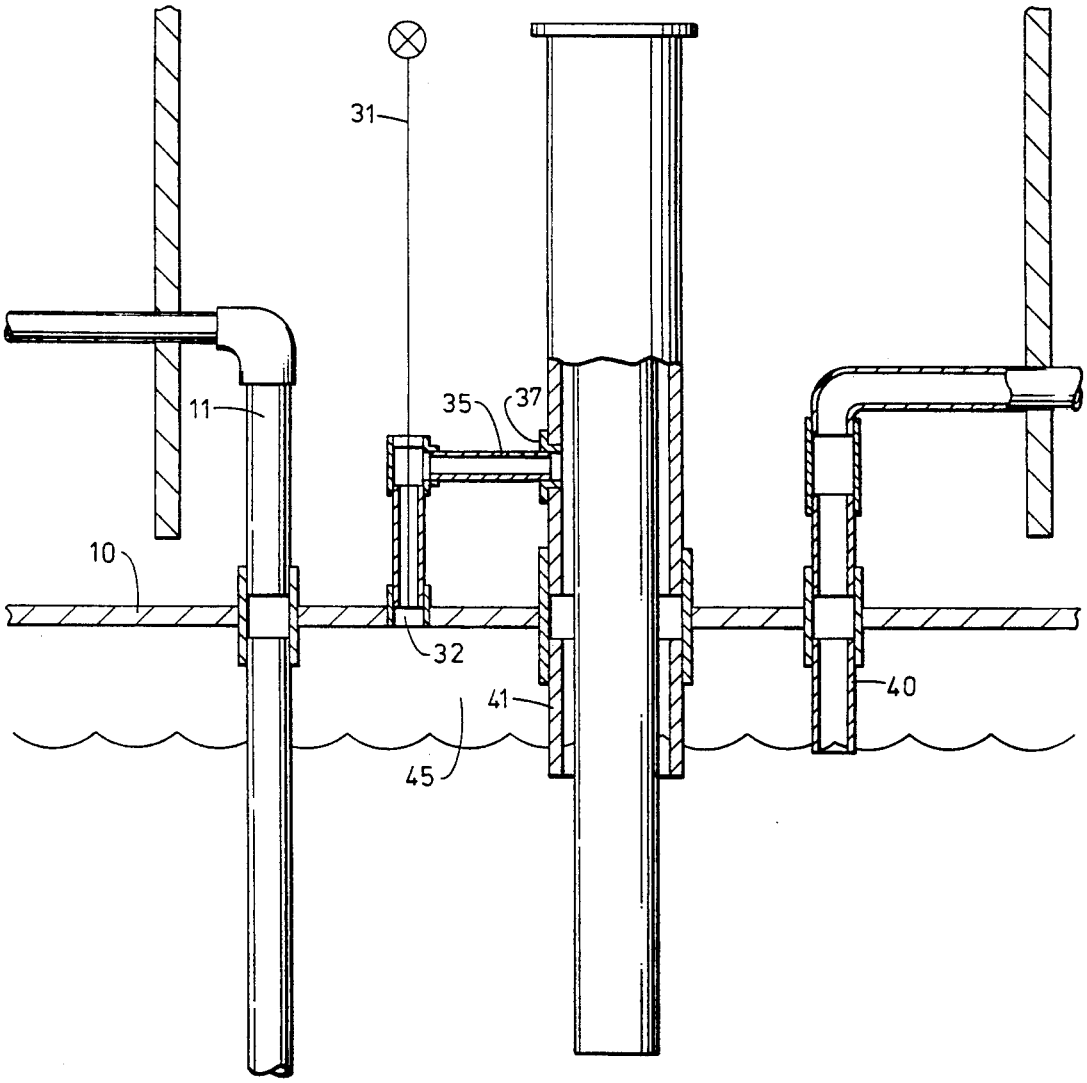
FIG. 4 is a partial side view in section showing another internal retained capacity area within a storage tank as defined by the end of a vent extension line.

FIG. 4 illustrates an embodiment of the invention wherein the end of a vent extension line 40 is higher than the end of a vapor recovery extension tube 41. In this figure, the storage tank 10 and access lines perform the same function as above described with reference to FIGS. 1-3. However, the ends of the vent extension line 40 and vapor recovery extension tube 41 terminate at different levels within the storage tank. In this situation the retained capacity area 45 extends from the horizontal plane at the vent extension line's termination to the top inside surface of the rigid tank.

Figure 5:
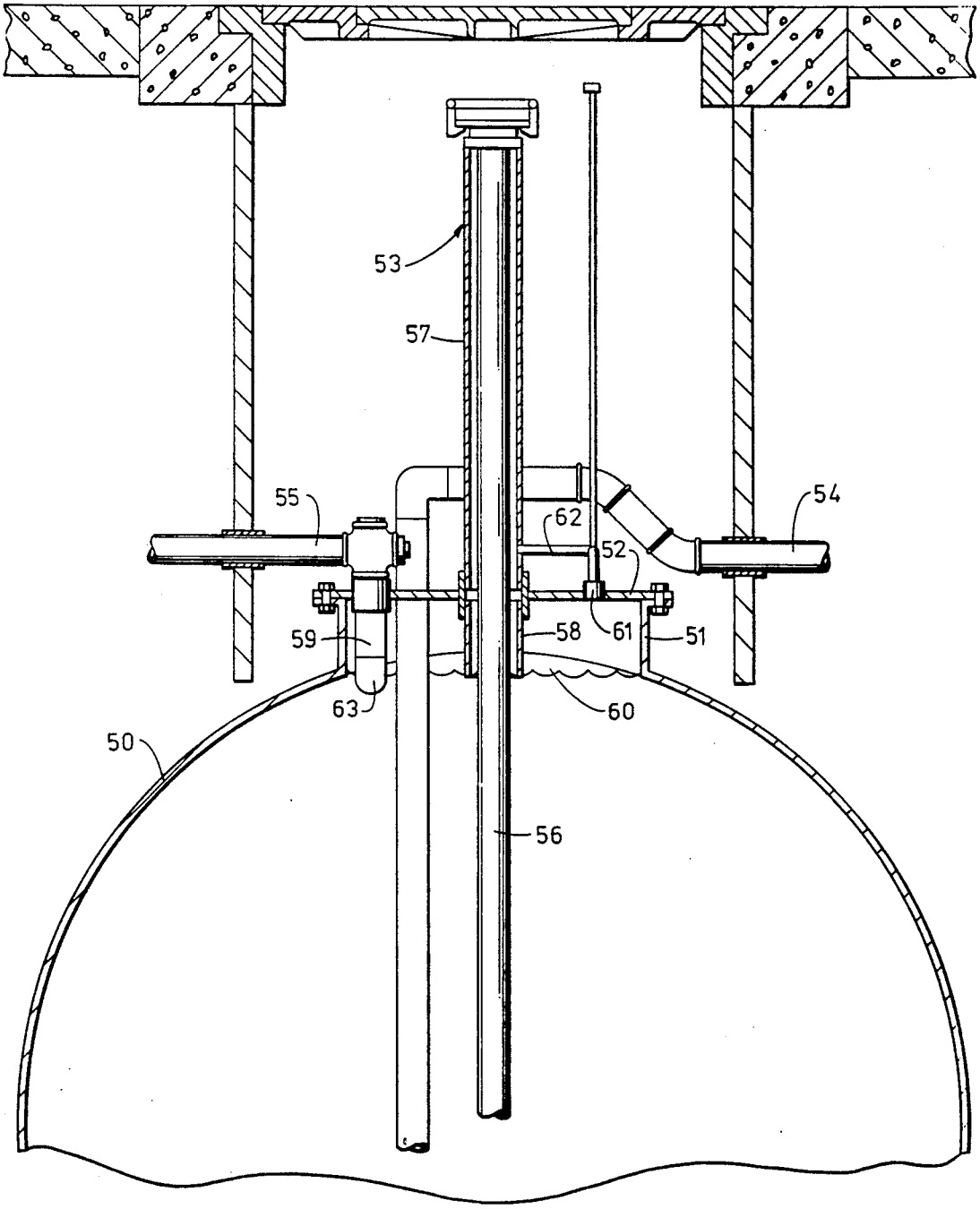
FIG. 5 is an end view illustrating another storage tank system of this invention wherein a manway is positioned on top of a storage tank.

FIG. 5 illustrates another type of storage tank useful with the invention. As shown, the tank 50 has a manway 51 for access to its interior. The manway is secured in a liquid tight fashion to the top of the storage tank. The manway's primary function is to serve as an access way to gain entry to the interior of the tank 50. It is generally cylindrical in shape and preferably sized about one to three feet in diameter. Other shapes and dimensions can be utilized. A lid 52, opening into the storage tank's interior, is securely attached to the manway 51. It is securely fastened, preferably in liquid tight fashion by known attachment means, e.g., bolts and nuts. The lid also serves as a surface through which the access lines pass. Disconnecting all lines passing through the lid and removal of the lid itself will allow an individual to enter the tank.

A coaxial fill line 53, dispensing line 54 and vent line 55 all individually enter through the lid covering the manway. The coaxial fill line 53 has an interior fill pipe 56 through which the liquid gasoline flows during the filling operation and a concentric outer pipe which serves as the vapor recovery tube 57. A vapor recovery extension tube 58 leads into the interior of the rigid tank. Similarly, the vent line 55 has an extension line 59 which extends into the tank approximately the same distance as extension 57. Extensions 58 and 59 each end from about two inches to about eighteen inches, preferably between about two inches to about five inches from the top inside surface of the lid 52. The internal retained capacity area 60 of the storage tank is that area which extends from an imaginary plane level with the vapor recovery extension tube termination and vent extension line termination which is uppermost to the top inside surface of the manway. Thus, the internal capacity area 60 can include all or a part of the area within the manway and a portion or none of the tank's storage area.

A trapped vapor release valve 61 operably associated with the retained capacity area and the vapor recovery tube 57 directly through a by-pass vent line 62 is also provided and works in a manner as above described. Also shown, is an optional ball float valve 63 mounted on the vent extension line 59 termination to prevent liquid from entering the vent line 55 during a filling operation.

Figure 6:
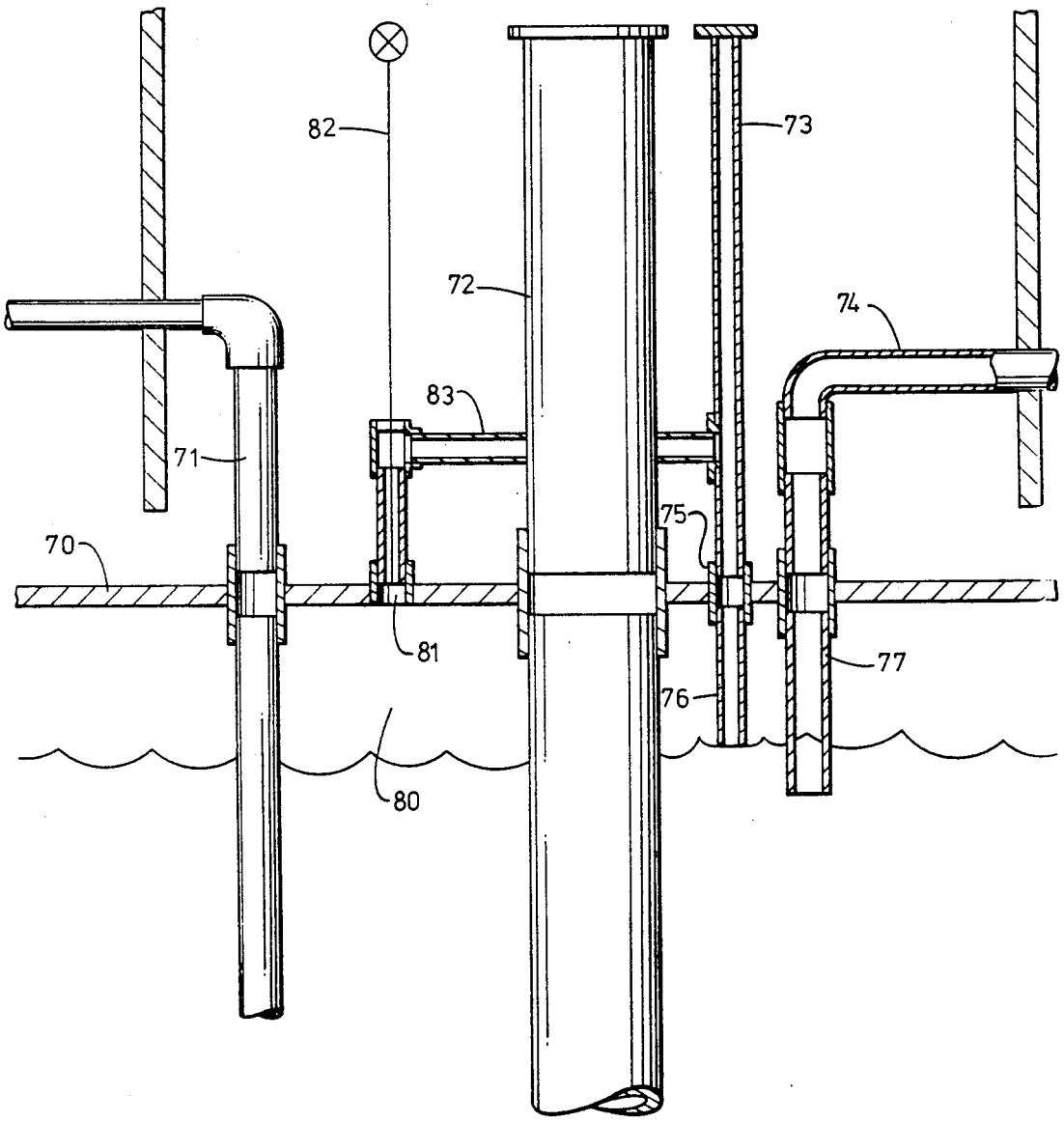
FIG. 6 is a partial side view in section of a storage tank system of the invention having a two-point fill system.

A two point fill system is used in the embodiment of the invention shown in FIG. 6. There is shown a storage tank system of the type shown in FIG. 1 comprised of a rigid storage tank 70 with a dispensing line 71, fill pipe 72, vapor recovery tube 73, and vent line 74. The fill system is comprised of the fill pipe 72 and the vapor recovery tube 73. The vapor recovery tube 73 is separately attached to the storage tank. Similar to the vapor recovery tube of the coaxial fill system depicted in FIGS. 1-5, the tube 73 returns vapors formed within the storage tank during the filling operation to the transport tank truck, and thus, effectively handles such vapors without polluting the atmosphere. The vapor recovery tube 73 is securely fastened to a double tapped bushing 75 which is attached to the top of the tank 70. Removable caps (not shown) attach to cap adapters at a top end of the fill pipe 72 and the vapor recovery tube 73 prevent debris from entering the storage tank. Fill systems of this general nature are common and are mandated in many areas.

In accord with this invention, a vapor recovery extension tube 76 leading from the vapor recovery tube 73 extends from about two inches to about eighteen inches, preferably from about two inches to about five inches, from the top inside surface of the storage tank into the tank's interior. Also, a vent extension line 77 attached to the vent line 74 extends from about two inches to about eighteen inches, preferably from about two inches to about five inches, from the top inside surface of the storage tank 70 into the tank's interior. In this embodiment of the invention the internal retained capacity area of the storage tank is that area of the tank which is defined by an imaginary horizontal plane extending from the vapor recovery extension tube 76 termination and the vent extension line 77 termination which is uppermost within the tank and the upper inside walls of the tank. As depicted in FIG. 6 the retained capacity area 80 extends from the termination of the vapor recovery extension tube 76.

Similar in operation to the storage tanks with coaxial fill systems depicted in FIGS. 1-5, the storage tank system of FIG. 6 has a single trapped vapor release valve 81 with a control rod 82 in operable association with the internal retained capacity area 80. a by-pass vent line 83 leads directly from the release valve 81 to the vapor recovery tube 73. The single release valve and by-pass vent line are readily installed in new or used storage tanks with two-point fill systems. The function of the retained capacity area 80 and the control of pressure within it by the trapped vapor release valve and by-pass vent line is the same as above described.

In operation, a gasoline transport truck is parked adjacent a ground access area for a fill pipe leading to a storage tank. The delivery hose is connected to a fitting on the fill pipe and the pressure release valve is closed. Gasoline flows through a fill pipe into the rigid tank until a build-up of pressure in the storage tank's retained capacity area causes the gravity flow of gasoline to that area of the storage tank itself to cease. Liquid will continue to flow by gravity to occupy the fill pipe, vapor recovery tube and vent line if a ball float is not used. A flow valve at the transport truck is closed. Next, the trapped vapor release valve associated with the retained capacity area is opened. Pressure build-up in the tank is relieved back to the truck's tank, thereby allowing gasoline left primarily in the delivery hose and fill pipe to flow by gravity to the retained capacity area of the storage tank.

While the invention has been described with respect to certain embodiments, it should be understood that various modifications may be made without departing from the spirit and scope of the claims.

What is claimed is:

1. An underground storage tank system having an internal retained capacity area for receiving overflow of liquid resulting from a filling operation through a delivery hose of a transport tank truck, comprising:

(a) a rigid storage tank having a storage capacity of at least about 1,000 gallons of liquid;

(b) a fill pipe extending from near ground surface into the storage tank for delivering liquid therethrough;

(c) a vapor recovery tube attached to the storage tank and a vapor recovery extension tube extending from the vapor recovery tube into the storage tank with a lower end of said extension tube terminating from about two inches to about eighteen inches from a top inside surface of the storage tank whereby said vapor recovery extension tube and vapor recovery tube receive vapors formed within the storage tank during the filling operation;

(d) a vent line attached to the storage tank and a vent extension line extending from the vent line into the storage tank with a lower end of said vent extension line terminating from about two inches to about eighteen inches from the top inside surface of the storage tank, wherein the area within the storage tank which is above the vapor recovery extension tube termination and vent extension line termination which is uppermost represents the internal retained capacity area;

(e) a dispensing line leading from within the storage tank to a dispenser at ground surface;

(f) a single trapped vapor release valve in operable association with the internal retained capacity area so that when closed during a filling operation a build up of pressure occurs within the storage tank to prevent liquid from completely occupying the internal retained capacity area and when opened permits excess liquid in the fill pipe to freely flow into the retained capacity area; and (g) a by-pass vent line leading directly from the trapped vapor release valve to the vapor recovery tube so that upon the opening of the trapped vapor release valve trapped vapors in the internal retained capacity area exit the storage tank through the by-pass vent line and vapor recovery tube.

2. The storage tank system of claim 1 wherein the vent extension line and the vapor recovery extension tube each extend individually from about two inches to about five inches into the storage tank.

3. The storage tank system of claim 2 wherein the vent extension line extends into the storage tank to a level greater than that of the vapor recovery extension tube and the area within the storage tank above the termination of the vapor recovery extension tube represents the internal retained capacity area.

4. The storage tank system of claim 2 wherein the vent extension line extends into the storage tank to a level less than that of the vapor recovery extension tube and the area within the storage tank above the termination of the vent extension line represents the internal retained capacity area.

5. The storage tank system of claim 2 wherein the vapor recovery extension tube extends into the storage tank to a level approximately equal to that of the vent extension line.

6. The storage tank system of claim 1 wherein the vapor recovery tube and the vapor recovery extension tube are concentric with the fill pipe to form a coaxial fill system.

7. The storage tank system of claim 1 wherein the vapor recovery tube is attached to the storage tank in close proximity to an area of the tank where the fill pipe is attached to form a two-point fill system.

8. The storage tank system of claim 1 wherein the storage tank has a manway extending from its top surface and a lid attached to the manway, wherein the area within the manway represents at least a part of the storage tank's storage area.

9. The storage tank system of claim 8 wherein at least a part of the area within the manway represents the storage tank's internal retained capacity area.

10. The storage tank system of claim 9 further wherein the fill pipe and vent line are attached to the lid on the manway.

11. The storage tank system of claim 1 wherein the storage tank holds at least about 4,000 gallons of liquid.

12. The storage tank system of claim 1 further comprising a ball float valve mounted in the lower end of the vent extension line to prevent liquid from entering said vent extension line.

* * * * *